United States Patent [19]

Kamiya

[11] 4,248,166

[45] Feb. 3, 1981

[54] SEWING MACHINE ATTACHMENT

[75] Inventor: Osamu Kamiya, Nagoya, Japan

[73] Assignee: Brother Kogyo Kabushiki Kaisha, Nagoya, Japan

[21] Appl. No.: 44,954

[22] Filed: Jun. 4, 1979

[30] Foreign Application Priority Data

Jun. 13, 1978 [JP] Japan ..... 53-71648

[51] Int. Cl.[3] ..... D05B 37/00; D05B 3/02

[52] U.S. Cl. ..... 112/122; 112/77; 112/158 R

[58] Field of Search ..... 112/122, 123, 125, 126, 112/261, 127, 128, 129, 77, 160, 158 R, 158 B

[56] References Cited

U.S. PATENT DOCUMENTS

| | | | |
|---|---|---|---|
| 2,432,545 | 12/1947 | Sigoda | 112/122 X |
| 2,443,369 | 6/1948 | Alifano et al. | 112/128 |
| 2,472,862 | 6/1949 | Sigoda | 112/127 |
| 2,917,013 | 12/1959 | Burgert | 112/127 |
| 3,029,759 | 4/1962 | Sigoda | 112/127 |
| 3,149,590 | 9/1964 | Fowler, Sr. | 112/127 |
| 3,421,463 | 1/1969 | Happe et al. | 112/77 |

*Primary Examiner*—H. Hampton Hunter

*Attorney, Agent, or Firm*—George B. Oujevolk

[57] ABSTRACT

Disclosed is a sewing machine attachment which is adapted to be detachably attached, after opening a part of a machine bed, to the portion of the machine bed in the vicinity of the opened part, and to be operatively connected to a motion mechanism in the machine bed through the opened part of the machine bed. The attachment actuating mechanism includes a connection arm which is adapted to extend through the opened part of the machine bed into engagement with the motion mechanism in the machine bed, when a lock lever is moved to a position for locking the attachment to the machine bed. The connection arm is further adapted to be disengaged from the motion mechanism in the machine bed, as the lock lever is moved back to a position for releasing the attachment from the machine bed.

8 Claims, 7 Drawing Figures

SEWING MACHINE ATTACHMENT

BACKGROUND OF THE INVENTION

The present invention relates to a sewing machine attachment such as, for example, a trimming attachment, buttonhole attachment, monogrammer attachment or the like.

For performing a sewing operation with such an attachment, in most cases, the attachment is attached to a pressure bar of the sewing machine and the mechanism for actuating the attachment is driven by an endwise reciprocation of a needle bar. Such an arrangement, however, is not appropriate in case where a heavy load is applied to the attachment during operation of the latter, because the attachment makes an idle movement together with the pressure bar.

A sewing machine attachment has been known having an attachment frame which is mounted on the machine bed such that the attachment is located in the vicinity of an opened part of the machine bed which is exposed as a throat plate on the machine bed is removed or a slide plate positioned adjacent to the throat plate is opened, the attachment frame being fixed to the predetermined portion of the machine bed by means of a plurality of fixing screws. In such a case, the actuating mechanism for actuating the attachment is operatively connected by a subsequent manual operation to the loop taker mechanism, work feeding mechanism or the like motion mechanism. In such a conventional technique or prior art, it is necessary to use a screw driver or the like tool. Namely, the operator has to tighten or loosen the plurality of fixing screws by means of the screw driver, and to bring the actuating mechanism for the attachment into or out of engagement with the motion mechanism in the machine bed by manual work. The preparatory work for making the sewing machine attachment operation is, therefore, highly troublesome and time consuming. For this reason, conventionally, it has been impossible to start a sewing operation which necessitates the attachment immediately after the sewing operation which does not employ the attachment, or, alternatively, to start the sewing operation immediately after the sewing operation which makes use of the attachment.

SUMMARY OF THE INVENTION

The invention has been accomplished in view of the above stated fact.

It is therefore a major object of the invention to provide a novel sewing machine attachment which can overcome the aforesaid problem of the prior art.

More specifically, the invention aims at providing a sewing machine attachment which can be locked on and released from the machine bed and engaged with and disengaged from the motion mechanism in the machine bed by a single action.

To this end, a preferred embodiment of the invention comprises an actuating mechanism including a connection arm projecting downwardly from the attachment frame, and adapted to be releasably connected to an motion mechanism in the machine bed through the connection arm; a manually operable lock lever for detachably locking the attachment on the machine bed, the lock lever being engageable with the engagement shaft disposed in the vicinity of an opened portion of the machine bed; a spring adapted to bias the connection arm into connection with the motion mechanism in the machine bed through the opened portion of the latter, in such a state that the attachment is locked; and an actuating portion formed on the lock lever and engageable with the connection arm so as to cause a movement of the connection arm against the action of the spring in response to a movement of the lock lever from the locking position to the releasing position. Therefore, the actuating mechanism of the attachment is brought into and out of engagement with the motion mechanism in the machine bed in relation to the manual operation of the lock lever for locking and releasing the attachment on and from the machine bed.

DESCRIPTION OF THE PREFERRED EMBODIMENTS

A trimming attachment embodying the present invention will be described hereinunder with reference to the accompanying drawings.

Figure 1:
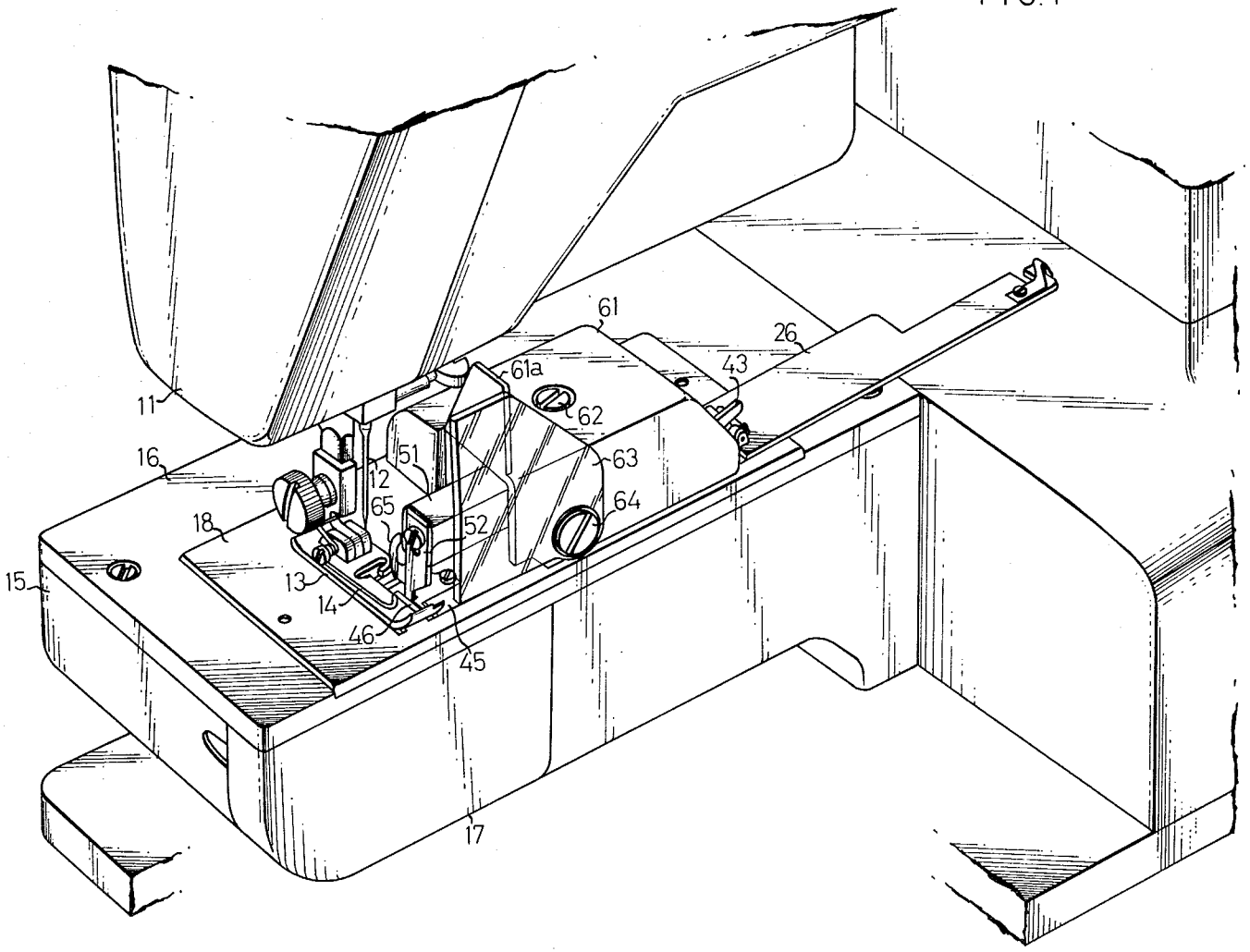
FIG. 1 is a perspective view of an essential part of a sewing machine, in a state in which a trimming attachment embodying the present invention is carried by the machine bed.

Referring to the drawings, a needle bar and a pressure bar which are known per se are attached to the head of a bracket arm 11. A needle 12 and a pressure foot 13 are secured to the lower ends of these bars. The pressure foot 13 is biased by a spring 14 in the clockwise direction as viewed in FIG. 1, and is positively pressurizing at its front end a work fabric. This ensures the correct feed of the work fabric effected by a feed dog 19. Consequently, the edge of the work fabric is stably cut by the latter-mentioned trimming attachment.

A cylindrical bed 15 of the sewing machine is provided with an upper plate 16 fixed to the upper surface thereof, and a cover 17 openably attached to the left front portion thereof.

A throat plate 18 is fixed to the above-mentioned upper plate 16. On the throat plate 18 are formed an elongated needle aperture **18*a* for zigzag stitching extending at a right angle to the direction of feed of work fabric, and apertures 18*b* for a feed dog 19 extending in the same direction as the direction of feed. An opening 20 is formed at the right front part of the throat plate 18, for permitting attaching of the trimming attachment. As will be seen from FIGS. 2 and 3, horizontal supporting seats 20*a*, 20*b* are formed substantially at the central portion of the rear edge of the opening 20, and at the right portion of the opening 20 between the front and rear ends of the latter, respectively. The right supporting seat 20*b* has an aperture 20*c* formed therein. In the described embodiment, the upper plate 16 and the throat plate 18** in combination forms an upper plate unit in the upper surface of which formed is a work supporting surface.

Figure 3:
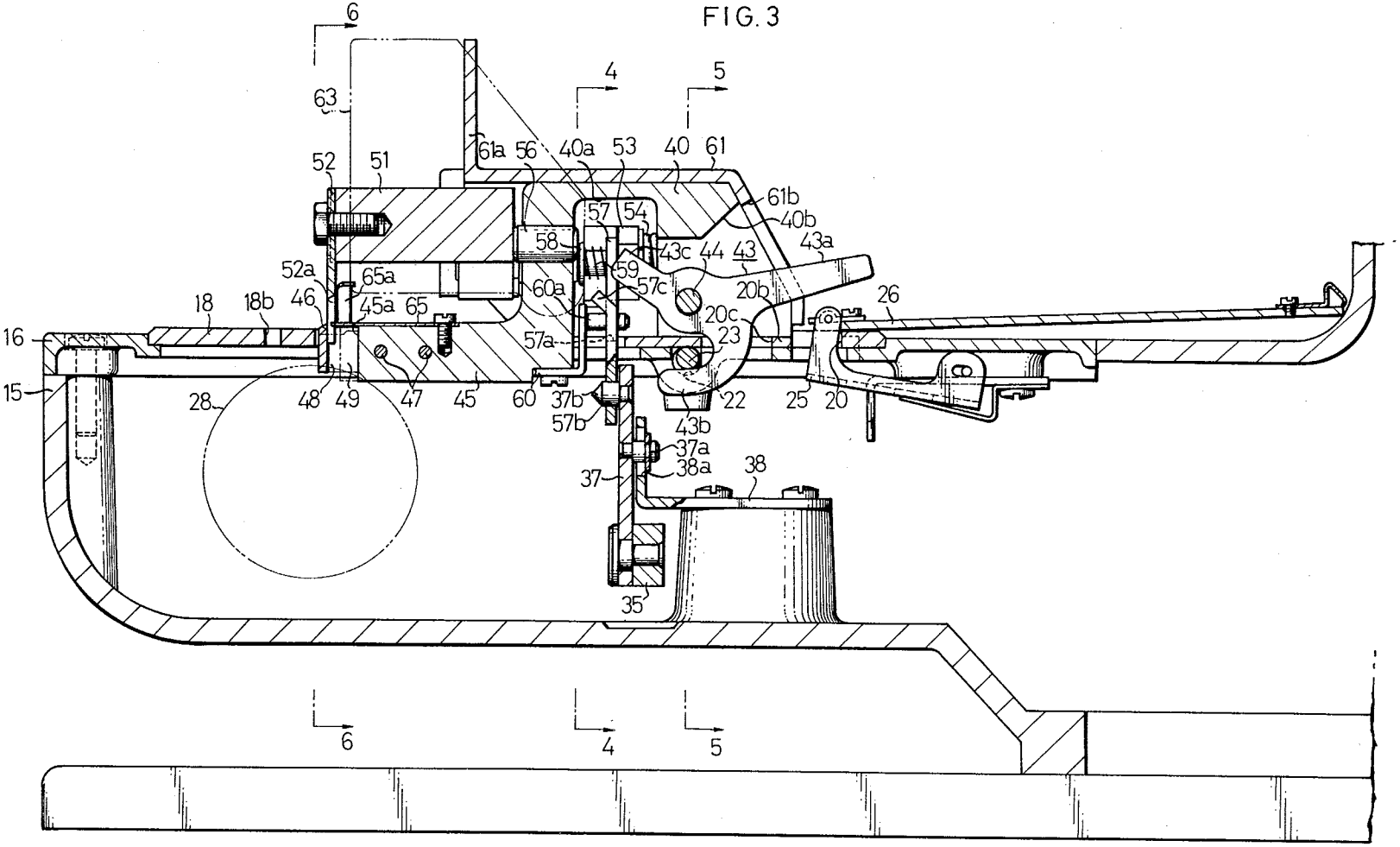
FIG. 3 is a sectional view taken substantially along the line 3—3 of FIG. 2.
Figure 5:
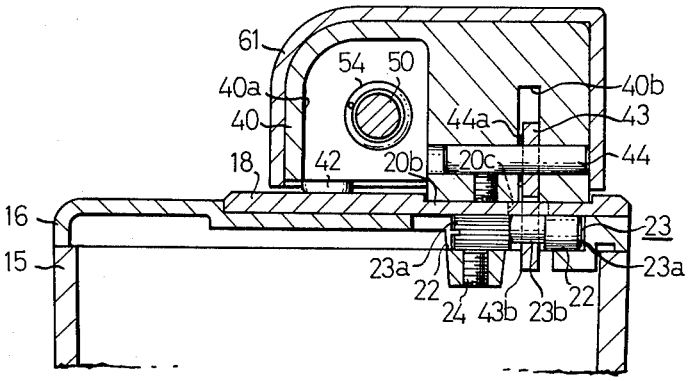
FIG. 5 is a sectional view taken substantially along the line 5—5 of FIG. 3.

A left and right engaging ports 21 are formed in the supporting seats 20*a*, 20*b* of the throat plate 18. A front and a rear attaching recesses 22 are formed in the upper plate 16 at a position substantially intermediate between the pair of engaging ports 21 under the aperture 20*c* of the throat plate 18. As shown in FIGS. 3 and 5, the upper openings of these recesses are closed by the throat plate 18. A horizontal eccentric shaft 23 is supported by the attaching recesses 22 so as to extend between these recesses. The shaft 23 is provided at its each end with a portion 23*a* at which it is fixed in the associated attaching recess 22 for free rotation around a horizontal axis by means of a fixing screw 24. The eccentric shaft 23 is also provided with a central portion 23*b* which extends along a horizontal axis offset from the axis of the portions 23*a*. The arrangement is such that the angular position of the central portion 23*b* can optionally be adjusted.

A supporting plate 25 is rotatably attached to the lower surface of the upper plate 16 to project slightly upwardly from the right end portion of the opening 20 of the throat plate 18 in accordance with the rotation itself. A cover plate 26 is hinged to the left end of the upper portion of the supporting plate 25 for openably closing the opening 20. For attaching the trimming attachment, this cover plate 26 is swung to the opening position as shown in FIG. 3. To the contrary, for the ordinary sewing operation, this cover plate 26 is swung from the opening position to the closing position to close the opening 20 so that the sewing operation may be smoothly effected by making use of whole part of the work supporting surface constituted by the upper surfaces of the upper plate 16, throat plate 18 and the cover plate 26.

Figure 4:
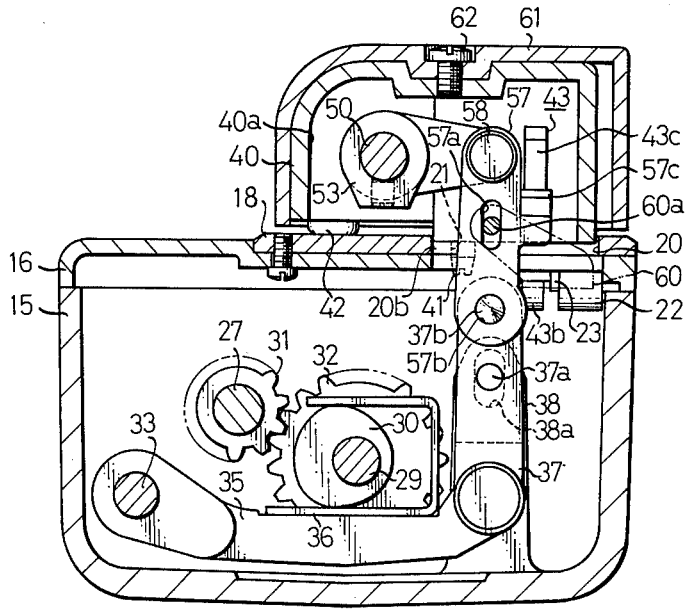
FIG. 4 is a sectional view taken substantially along the line 4—4 of FIG. 3.

Referring to FIG. 4, a driving shaft 27 of a loop taker mechanism is rotatably disposed in the machine bed 15 so as to extend in the direction perpendicular to the direction of feed of the work fabric. This driving shaft 27 is adapted to drive a loop taker 28 shown in FIG. 3, through a suitable gear mechanism. A cam shaft 29 of the feed mechanism is rotatably mounted in the machine bed 15 and extends in parallel with the driving shaft 27. A feed advancing cam (not shown) for actuating the feed dog 19 and a cam 30 for actuating the attachment are fixed to the cam shaft 29. The cam shaft 29 is connected through gears 31, 32 to the driving shaft 27, so that it is rotated at a reduced speed as the driving shaft 27 rotates.

Figure 2:
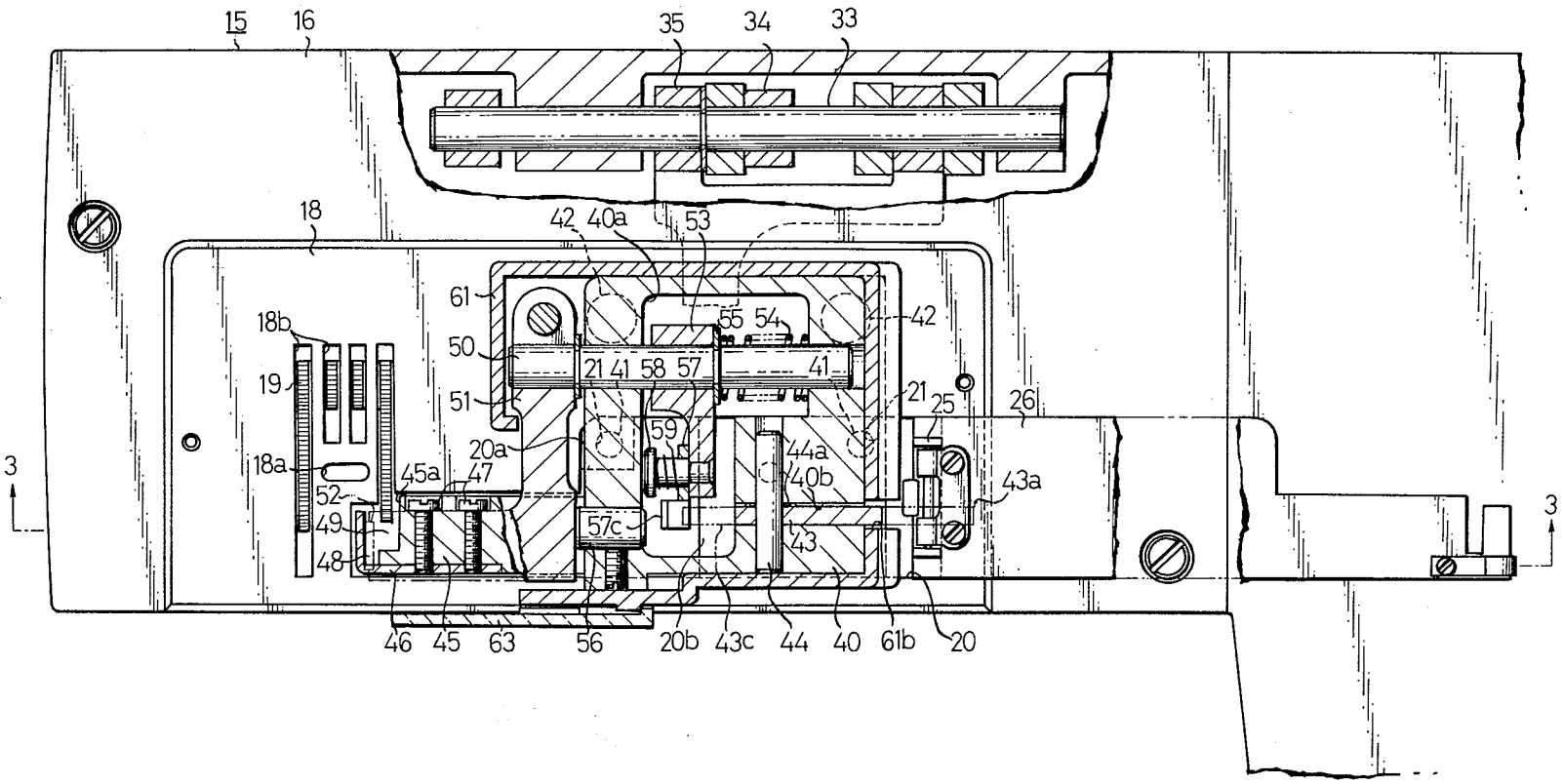
FIG. 2 is a partly sectioned plan view of an essential part of the attachment shown in FIG. 1.

In the lower portion of the rear end part of the space in the machine bed 15, disposed is a stationary shaft 33 extending in parallel with the driving shaft 27. As shown in FIG. 2, a feed arm 34 of the feed mechanism is swingably supported on the stationary shaft 33.

An actuating arm 35 is swingably supported at its rear forked portion by the stationary shaft 33. As shown in FIG. 4, a forked piece 36 engaging the cam 30 is fixed to the middle portion of the actuating arm 35. The arrangement is such that the actuating arm 35 is swung by the cam 30 in accordance with the rotation of the cam shaft 29. An actuating link 37 is pivoted at its lower end to the front end portion of the actuating arm 35. As shown in FIGS. 3 and 4, a guide pin 37*a* is provided to project from the right side surface of the actuating link 37, while, on the left side surface of the upper end, formed is an interlocking pin 37*b* having a conical portion.

A limiting plate 38 is fixed to the upper surface of the bottom wall of the machine bed 15, and is disposed close to the actuating link 37 at the right side of the latter. The vertical slot 38*a* is formed in a vertical portion of the limiting plate 38 for receiving the aforementioned guide pin 37*a*, so as to substantially limit the oscillating movement of the actuating link 37 but to allow the vertical movement of the same.

The aforementioned trimming attachment is adapted to be detachably fixed to the throat plate 18 such that it takes a position in the vicinity of the opening 20 of the throat plate 18, after opening of the cover plate 26. The construction of this trimming attachment will be described hereinunder.

As shown in FIGS. 2 to 5, an attachment frame 40 has a front half part of its lower end slightly projected downwardly so as to be mounted on the supporting seats 20*a*, 20*b* in the opening 20. A downwardly opening accommodating portion 40*a* is formed in the attachment frame 40. In the right-hand side end of the attachment frame, near the front end of the same, formed is a vertical attaching groove 40*b* which opens from the accommodating portion 40*a* to the right surface of the frame. A pair of vertical pins 41 are provided on the lower end projection of the attachment frame 41, near the rear end of the lower end projection. As will be seen from FIGS. 2, 4 and 6, the vertical pins 41 engage corresponding engaging ports 21, when the attachment frame 40 is placed in the vicinity of the opening 20 of the throat plate 18, thereby positioning the attachment frame 40 in the back and forth direction, as well as in the lateral direction.

A left and a right supporting legs 42 made of rubber are provided on the lower surface of the attachment frame 40 near the rear end of the lower surface. In the attached state of the attachment frame, these supporting legs 42 abut the upper surface of the throat plate 18 so as to support the attachment frame 40 stably on the throat plate 18.

A three-arm lock lever 43 is disposed in the attaching groove 40*b* and rotatably supported by the attachment frame 40 by means of a horizontal supporting pin 44 which is fixed to the attachment frame 40 to extend at a right angle to the attaching groove 40*b*. As will be seen from FIGS. 3 to 7, one of the arms of the lock lever 43 constitutes a manually operated portion 43*a* which projects laterally to the right from the attaching groove 40*b*. Another arm of the lock lever 43 constitutes a latching portion 43*b* which projects to the underside of the upper plate 16 from the attaching groove 40*b* through the aperture 20*c* of the throat plate 18, in the attached state of the attachment frame 40. The remainder arm constitutes an actuating portion 43*c* which projects from the attaching groove 40*b* into the accommodating portion 40*a*. A spring washer 44*a* is interposed between the attachment frame 40 and the lock lever 43, and is adapted to impart a frictional force to the lock lever 43 to hold the latter at any desired position of rotation.

Figure 7:
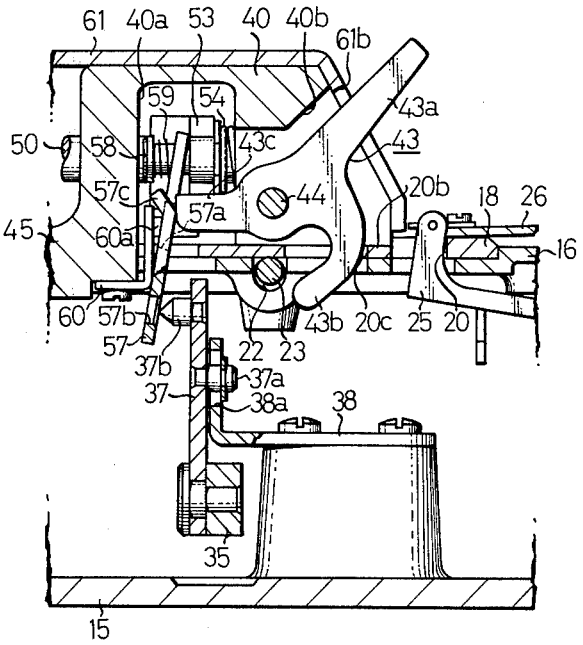
FIG. 7 is a sectional view corresponding to FIG. 3, showing the attachment in a different state of operation.

With the attachment frame 40 disposed in the vicinity of the opening 20 of the throat plate 18 as shown in FIG. 7, as the lock lever 43 is operated through the manually operated portion 43*a* to rotate from the releasing position shown in FIG. 7 in the clockwise direction, the cam surface of the latching portion 43*b* of the lock lever 43 comes into engagement with the central portion 23*b* of the eccentric shaft 23 on the upper plate 16, from the underside of the latter, at a position substantially intermediate between the pair of engaging ports 21 receiving respective vertical pins 41, as will be understood from FIGS. 2, 3 and 5, thereby to fix the attachment frame 40 against upward movement.

A projecting arm 45 is formed unitarily with the attachment frame 40 to extend laterally to the left from the lower portion of the front end of the left-hand side part of the attachment frame 40. As will be seen from FIGS. 2 and 3, a notch 45*a* is formed at the rear part of the left end portion of the projecting arm 45. In the attached state of the attachment frame 40, the projecting arm 45 is received by the opening 20 of the throat plate 18 so as to extend in the direction crossing the direction of feed of the work fabric, such that the upper end surface thereof occupies substantially same plane as the work supporting surface, i.e. the upper surface of the throat plate 18.

A stationary blade 46 having a substantially L-shaped plan is fixed at its base portion to the front surface of left end of the projecting arm 45 by means of a pair of screws 47. As shown in FIGS. 2 and 3, in the attached state of the attachment frame 40, the cutting edge of this stationary blade 46 is positioned substantially in the same plane as the work supporting surface at the front side of the needle aperture 18*a* of the throat plate 18, in the close proximity of that aperture 18*a*. Between the cutting edge and the left end portion of the projecting arm 45, formed is a gap 48 for allowing a later-mentioned movable blade to come thereinto and a gap 49 which is continuous from the gap 48 and adapted to allow the front end of the feed dog 19 located at the right side of the aperture 18*a* to project therethrough.

Figure 6:
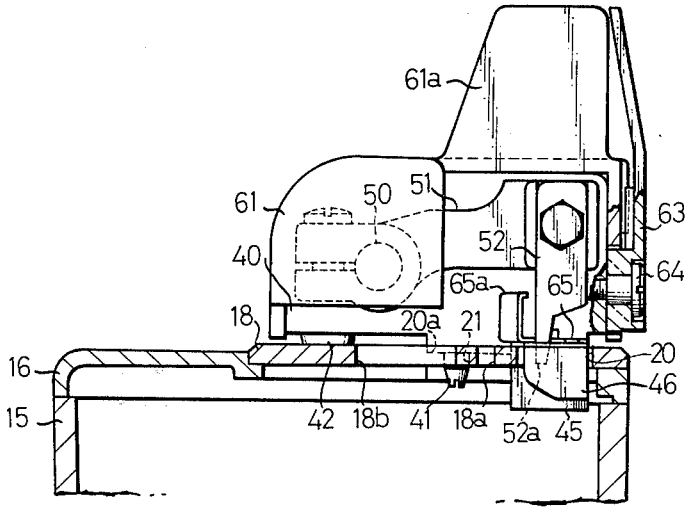
FIG. 6 is a sectional view taken substantially along the line 6—6 of FIG. 3.

A drive shaft 50 is rotatably received and supported by a bore formed near the rear end of the attachment frame 40 so as to extend at a right angle to the direction of feed of the work fabric. A driving arm 51 having a substantially L-shaped plan is attached to the left end projecting portion of the drive shaft 50. As shown in FIGS. 2, 3, and 6, the front end portion of the driving arm 51 extends in parallel with the aforementioned projecting arm 45 above the latter with a certain space left therebetween, so that the driving arm 51 is moved up and down in accordance with the reciprocatory rotary movement of the drive shaft 50.

The aforementioned movable blade 52 is attached to the left end of head portion of the driving arm 51, and is provided at its lower end portion with a cutting edge and a guiding projection 52*a*. The movable blade 52 is adapted to cooperate with the stationary blade 46 in cutting the marginal edge of the work fabric which is being fed in the feeding direction, in advance of the overedge stitching, in accordance with the reciprocatory rotary movement of the drive shaft 50.

A rock arm 53 is accommodated by the accommodating portion 40*a* of the attachment frame 40, and is fixed to substantially central portion of the drive shaft 50 so as to rock integrally with the movable blade 52. A compression spring 54 is disposed between the right inner surface of the accommodating portion 40*a* and a spring retainer 55 provided on the drive shaft 50. This compression spring 54 is adapted to bias the drive shaft 50 and the driving arm 51 to the left, so as to press the movable blade 52 against the stationary blade 46. A displacement limiting pin 56 is laterally adjustably secured to the left front portion of the attachment frame 40 above the projecting arm 45 so as to contact the right end portion of the arm portion of the driving arm 51. The displacement limiting pin 56 is adapted to prevent the driving arm 51 from being moved to the right, when a rightward force is applied to the movable blade 52 to urge the latter away from the stationary blade 46 during cutting of the thick fabric, thereby to ensure a smooth trimming operation.

A connection arm 57 is attached at its upper end to the front end of the rocking arm 53 for free rotation and displacement in the axial direction, by means of an attaching pin 58. As will be seen from FIGS, 3, 4 and 7, when the attachment frame 40 is positioned in the vicinity of the opening 20 of the throat plate 18, the lower end of the connection arm 57 is projected downward from the attachment frame into the machine bed 15 through the opening 20. A vertical slot 57*a* is formed substantially at the center of the connection arm 57, while, at the lower end of the connection arm 57, formed is a bore 57*b* engageable with the interlocking pin 37*b* of the actuating link 37 disposed in the machine bed 15. An abutment portion 57*c* formed by bending at the front edge of substantially mid-point of the connection arm 57 is adapted to engage with the actuating portion 43*c* of the lock lever 43.

A compression spring 59 disposed between the head of the attaching pin 58 and the connection arm 57 is adapted to bias the connection arm 57 toward the actuating link 37, in the attached state of the attachment frame 40. A guide plate 60 is fixedly disposed in the accommodating portion 40*a* of the attachment frame 40 so as to correspond to the above-mentioned connection arm 57. As will be seen from FIGS. 3 and 4, a guide pin 60*a* adapted to be fitted into a vertical slot 57*a* of the connection arm 57 is formed to project from the right side of upper end portion of the guide plate 60, so as to substantially limit the rocking of the connection arm 57 but to allow the vertical movement of the same.

A casing 61 is fixed by means of a screw 62 to the upper end of the attachment frame 40 to cover the latter. As will be seen from FIG. 3 and 6, a shield plate portion 61*a* for covering the right upper part of the driving arm 51 is formed on the left upper surface of the casing 61 to project from the latter. Also, at the right side of the casing 61 which aligns with the attaching groove 40*b* of the attachment frame 40. A transparent protective cover 63 is rotatably attached to the front surface of the attachment frame 40 by means of a stepped screw 64 at the front surface of the casing 61 near the left end of the same.

As will be seen from FIGS. 1, 2, 3 and 6, the transparent protective cover 63 rotated to the left operative position closes the front side of the space between the driving arm 51 and the projecting arm 45, so as to exclude danger to place the operator's finger in the above-mentioned space or in the cutting section constituted by the stationary and movable blades 46,52, during the sewing operation. A resilient plate 65 fixed to the left upper surface of the projecting arm 45 is adapted to cover at its left end portion the gaps 48,49 between the projecting arm 45 and the stationary blade 46 so as to prevent fabric dusts or trimmings from coming into these gaps. At the same time, the resilient plate 65 is so constructed to come in contact with the movable blade 52 and to curved to protrude into the gaps 48,49. Also, an upright portion 65*a* formed on the rear part of the left end portion of the resilient plate 65 is adapted to guide the fabric dusts or trimmings rightwardly toward the rear side.

Hereinafter, a description will be made as to how the sewing machine and the trimming attachment having the described constructions operate.

For effecting an overedge stitching while trimming the marginal edge of the work fabric with the trimming attachment having the described construction, at first the cover plate 26 closing the opening 20 of the throat plate 18 on the machine bed 15 is rotated in the direction to open the opening 20. Subsequently, as shown in FIG. 7, the lock lever 43 of the trimming attachment is rotated to the releasing position to bring its actuating portion 43*c* into engagement with the abutment portion 57*c* of the connection arm 57 to displace the connection arm 57 to the left into the inclined posture. As the attachment frame 40 is placed in this state in the vicinity of the opening 20 of the throat plate 18, the pair of vertical pins 41 come to be received by corresponding engaging ports 21 of the supporting seats 20*a*, 20*b* on the throat plate 18 thereby to position the attachment frame in the back and forth direction, as well as in the lateral direction.

Thereafter, as the lock lever 43 is rotated clockwise from the releasing position shown in FIG. 7 by means of the manually operated portion 43*a*, the cam surface of the latching portion 43*b* of the lock lever 43 comes into engagement with the central portion 23*b* of the eccentric shaft 23 from the underside of the latter, at a position substantially midway between the engaging ports 21 receiving respective vertical pins 41, as will be seen from FIGS. 2, 3 and 5. Consequently, the attachment frame 40 is locked on the throat plate 18 in the vicinity of the opening 20, against the upward movement. In this state, the upper end surface of the projecting arm 45 extending laterally from the left side of the attachment frame 40 occupies substantially the same plane as the upper surface of the work supporting surface, i.e. the upper surface of the throat plate 18. At the same time, the cutting edge of the stationary blade 46 secured to the left side portion of the arm 45 is disposed in the substantially same plane as the work supporting surface and in the vicinity of the needle aperture 18*a* of the throat plate 18, at the front side of the aperture 18*a*. Also, the head portion of the driving arm 51 carrying the movable blade 52 comes to extend above the projecting arm 45, in parallel with the latter.

Meanwhile as a result of the rotation of the lock lever 43, the actuating portion 43*c* of the lock lever 43 is disengaged from the abutment portion 57*c* of the connection arm 57, so that the arm 57 is released from the inclined posture and is pressed toward the actuating link 37 in the machine bed 15 by the action of the compression spring 59. Therefore, even if the bore 57*b* of the connection arm 57 fails to be aligned with the interlocking pin 37*b* of the actuating link 37, this alignment is achieved in the following manner in the period of one cycle of vertical movement of the actuating link 37. Namely, as the sewing machine starts to operate, the driving shaft 27 is rotated to drive the cam shaft 29 through the gears 31,32 so as to reciprocatingly move the actuating link 37 through the cam 30, the forked piece 36 and the actuating arm 35. Within the period of one cycle of vertical reciprocating motion of the actuating link 37, the interlocking pin 37*b* of the link 37 is allowed to fit into the bore 57*b* of the connection arm 57, so that the cam shaft 29 and the drive shaft 50 of the movable blade 52 are operatively connected to each other automatically.

Then, as the sewing machine further continues to operate, the movable blade 52 is reciprocatingly driven up and down, through the actuating cam 30, forked piece 36, actuating arm 35, actuating link 37, connection arm 57, rock arm 53, drive shaft 50 and then the driving arm 51, so as to cooperate with the stationary blade 46 for trimming the marginal edge of the work fabric as the latter is fed in the feeding direction. At the same time, immediately after the trimming operation in the trimming section, an overedge stitching is performed by a cooperation of the needle 12 and the loop taker 28.

The ordinary sewing operation employing no trimming attachment is performed in the following manner.

In this case, the trimming attachment is detached from the machine substantially in the reverse precedure to the attaching procedure. Namely, for detaching the attchment, at first the lock lever 43 is rotated counterclockwise from the locking position shown in FIG. 3. As a result, the latching portion 43*b* of the lock lever 43 is disengaged from the central portion 23*b* of the eccentric shaft 23 on the upper plate 16, as shown in FIG. 7, so that the attachment is released from the locked state. Simultaneously, in accordance with the rotation of the lock lever 43, the actuating portion 43*c* of the latter is brought into engagement with the abutment portion 57*c* of the connection arm 57 so that the arm 57 is moved to left against the force of the compression spring 59 to take the inclined posture as shown in FIG. 7. As a result, the interlocking pin 37*b* of the actuating link 37 is disengaged from the bore 57*b* of the connection arm 57, so that the drive shaft 50 of the movable blade 52 in the attachment is disconnected from the cam shaft 29 of the feed mechanism in the machine bed. In this state, the attachment can easily be detached by simply lifting the attachment frame 40 upwardly from the throat plate 18. Then, the cover plate 26 is rotated to the position for closing the opening 20 of the throat plate 18. In this state, the upper surfaces of the upper plate 16, throat plate 18 and the cover plate 26 constitute a continuous work supporting surface which permit a smooth ordinary sewing operation.

The embodiment heretofore described is not exclusive, and various changes and modifications may be imparted thereto, without departing from the spirit of the invention.

For instance, it is possible to arrange such that the actuating link is actuated through a fork arm or the like by an actuating cam which is provided on the drive shaft of the loop taker mechanism.

It is also possible to arrange such that the locking and release of the attachment to and from the machine bed and the connection and disconnection of the attachment actuating mechanism to and from the motion mechanism in the machine bed can be achieved simultaneously by operating a locking member slidably mounted on the attachment frame for free left and rightward movement.

Although the invention has been described with specific reference to a trimming attachment, it will be clear to those skilled in the art that the present invention is equally applicable to other kinds of attachment such as a buttonhole attachment, monogrammer attachment and so forth.

As has been described, according to the invention, it is possible to fix the attachment to the machine bed and to operatively connect the attachment actuating mechanism to the motion mechanism in the machine bed, by a single action of a locking member, so that the attachment is rendered operative in quite an easy manner.

Further, for removing the attachment from the machine bed, the release of the attachment from the machine bed and the disconnection of the attachment actuating mechanism from the motion mechanism in the machine bed are performed simultaneously by a single action of the locking member.

It is remarkable that the sewing operation with or without the attachment can be immediately commenced without necessitating troublesome preparation work which has been necessary in the operation of conventional sewing machine.

What I Claimed Is:

1. An attachment for a sewing machine having a bed including a work supporting surface formed with an opening, a cover plate for openably closing said opening, a motion machanism mounted in said bed and including a work feeding mechanism, and an engagement member mounted in said bed for detachably locking said attachment on said bed over said opening, said attachment comprising;

an attachment frame, an actuating mechanism mounted on said frame and including a connection arm extending below said frame, said connection arm having at its lower end a part for interconnecting said actuating mechanism and said motion mechanism, a lock member mounted on said frame and manually operable for movement between a first position for engaging with said engagement member to lock said frame on said bed and a second position for disengaging from said engagement member to release said frame from said bed, means for urging said connection arm extending through said opening to be operatively connected with said motion mechanism in the locked state of said attachment frame, and means for disconnecting said connection arm from said motion mechanism against said urging means upon the manual operation of said lock member from said first position to said second position, whereby said actuating mechanism in said attachment is automatically connected with and disconnected from said motion mechanism in said bed in relation to the manual operation of said lock member for locking and releasing said attachment on and from said bed.

2. An attachment for a sewing machine according to claim 1, wherein said lock member comprising a three-arm lever pivotally mounted on said attachment frame, one arm of said three-arm lever constituting a manually operated portion, another arm thereof constituting a latching portion having a cam surface which is engageable with said engagement member on said bed, and the remainder arm constituting an actuating portion which is engageable with connection arm for shifting the same against said urging means.

3. An attachment for a sewing machine according to claim 2, wherein said engagement member comprises an eccentric shaft horizontally mounted on said bed and being adjustable for inhibiting an idle movement of said attachment frame.

4. An attachment for a sewing machine according to claim 1, wherein said motion mechanism in said bed includes a link reciprocating up and down in timed relation with said work feeding mechanism, said connection arm is mounted on said attachment frame for up and down movement, and said urging means comprises a coil spring urging said connection arm to toward said link for connecting said connection arm with said link at the first position of said lock member.

5. An attachment for a sewing machine according to claim 1, wherein said disconnecting means is provided between said lock member and said connection arm, and includes an abutment portion formed on said connection arm and an actuating portion formed on said lock member, said actuating portion being engageable with said abutment portion for shifting said connection arm against said urging means.

6. An attachment for a sewing machine according to claim 5, wherein a conical connection pin is secured to either one of said link and said connection arm, and a connection bore into which said pin fits is formed on the other thereof.

7. An attachment for a sewing machine according to claim 1, further comprising a stationary blade secured to said attachment frame, and a movable blade driven by said actuating mechanism for trimming the marginal edge of a work fabric in cooperation with said stationary blade.

8. An attachment for a sewing machine having a bed including a work supporting surface formed with an opening, a cover plate for openably closing said opening, a work feeding mechanism mounted in said bed, a link reciprocating under said opening and in timed relation with said work feeding mechanism, and an engagement shaft mounted in said bed for detachably locking said attachment on said bed over said opening, said attachment comprising;

an attachment frame, an actuating mechanism mounted on said frame and including a connection arm extending below said frame, said connection arm having at its lower end a part for being connected with said link, a lock lever pivotablly mounted on said frame and manually operable for movement between a first position for engaging with said engagement shaft on said bed and a second position for disengaging from said engagement shaft to release said frame from said bed, spring means urging said connection arm toward said link to be operatively connected with said link through said opening in the locked state of said attachment frame, and means provided between said lock lever and said connection arm for disconnecting the latter from said link against said spring means upon the manual operation of said lock lever from said first position to said second position, whereby said actuating mechanism in said attachment is automatically connected with and disconnected from said work feeding mechanism in said bed in relation to the manual operation of said lock lever for locking and releasing said attachment on and from said bed.

* * * * *